340-566 SR
5/10/83 XR 4,383,250

United States Patent [19]
Galvin

[11] 4,383,250
[45] May 10, 1983

[54] SYSTEM FOR INTRUSION DETECTION

[75] Inventor: Aaron A. Galvin, Lexington, Mass.

[73] Assignee: American District Telegraph Company, New York, N.Y.

[21] Appl. No.: 241,948

[22] Filed: Mar. 9, 1981

[51] Int. Cl.[3] ..... G08B 19/00; G08B 13/00
[52] U.S. Cl. ..... 340/521; 340/65; 340/511; 340/566; 340/571; 340/669
[58] Field of Search ..... 340/63, 65, 514, 515, 340/521, 522, 526, 527, 528, 529, 530, 531, 541, 544, 545, 550, 565, 566, 571, 669; 73/570, 614–617, 645–648

[56] References Cited

U.S. PATENT DOCUMENTS 4,223,304 9/1980 Barowitz et al. ..... 340/566

FOREIGN PATENT DOCUMENTS 642758 9/1928 France ..... 340/566

*Primary Examiner*—Donnie L. Crosland
*Attorney, Agent, or Firm*—Weingarten, Schurgin, Gagnebin & Hayes

[57] ABSTRACT

An intrusion detection sensor is mounted to a wall outside a vault, strong room, safe or protected area to detect both airborne indications of activity in the vicinity of the vault and also structure-borne indications of forced entry attempts. In one embodiment, one or more transducing elements are used to detect airborne and structurally-conducted signals, with the outputs thereof processed for producing an alarm indication when either type of signal exceeds an alarm threshold. Two detection channels are provided with one responsive to high band audio for detecting sounds and vibrations, whether airborne or structure-borne, indicating movement or activity immediately outside the vault or protected area, and the other responsive to airborne or structure-borne impulses and intermittent high level vibrations indicative of attempts at forced entry. Integration parameters for the impulse channel are oriented towards relatively long "memory" so that spaced hammer blows or vibrations will build up towards the alarm threshold. In one embodiment, a vibration block anchored to the wall transmits wall-carried impulses or vibrations to the same transducing element which is utilized to sense airborne indications of an intrusion. In another embodiment only structure-borne vibrations are detected with the use of a single transducing element and a vibration block.

8 Claims, 6 Drawing Figures

SYSTEM FOR INTRUSION DETECTION

FIELD OF INVENTION

This invention relates to intrusion detection systems and more particularly to a system which is sensitive to structure-conducted and/or air-conducted signals.

BACKGROUND OF THE INVENTION

For intrusion detection and more specifically to detect penetration of strong rooms, safes or vaults, it is oftentimes desirable to detect not only activity adjacent the vault indicating the presence of an intruder but also to detect the initial attempts at penetration of the vault. Intrusion detection usually is accomplished with the aid of air-conducted acoustic waves in which active ultrasonic detectors or passive acoustic detectors are utilized in the surveillance of a protected area. Moreover, some systems utilize microwave energy projected into the protected area, variations of which are detected to determine a alarm condition.

It will be appreciated that once an intruder has penetrated a protected area such as the vault, it is oftentimes too late for an alarm indication to be of real use because of the accessability of the valuables being protected. It is therefore necessary, in a wide variety of cases to provide "early warning" of a vault penetration so that appropriate early countermeasures may be taken.

While vault activity detectors have been utilized in the past, it is sometimes with difficulty that ordinary sounds and vibrations can be distinguished from those which would indicate an unauthorized penetration or attempted penetration of the vault, safe or strong room. Thus sensing vault activity alone may result in an unacceptable high false alarm rate.

As illustrated in U.S. Pat. Nos. 3,801,978; 4,103,293; 3,725,888; and 4,121,182, prior art detection systems have utilized multiple and differing sensors for sensing air-conducted signals. These sensors have been utilized singly or in combination to reduce the false alarm rate for the systems in which they are employed but do not deal with the combination of structurally-conducted signals and air-conducted signals for enhanced detected. As a result, the systems illustrated by the aforementioned patents do not necessarily provide a fail-safe "early warning" system usable for vault security.

SUMMARY OF THE INVENTION

In order to provide improved early warning, an intrusion detection sensor is mounted to a wall outside a safe, vault or strong room and is arranged to detect both airborne indications of the presence of an individual and also structure-borne indications of intrusion such as would accompany attempts at forced entry involving oxygen lances, diamond saws, drills, sledge hammers, and the like. In one embodiment, one or more transducing elements are used to detect airborne and structurally-conducted signals, with the outputs thereof processed for producing an alarm indication when either type of signal exceeds an alarm threshold. In one embodiment, an electret used as the transducing element operates as a microphone to detect airborne indications of activity and as an accelerometer to detect impulses and vibrations conducted in the wall of the structure. For human activity near the protected area, filtering of the signals from the transducing element establishes a high audio band, typically 10–20 Khz, for detecting sounds and low level continuous vibrations at or adjacent the vault. The high audio band is utilized because there is a maximum contrast between low level sounds and vibrations produced by activity outside or adjacent the vault and high level impulses or intermittent vibrations caused by attempts at forced entry. Unfiltered signals are used for impulse detection characteristic of forced entry attempts in which spaced impulses such as caused by hammer blows are recognized.

In summary, two detection channels are provided, with one responsive to low level high frequency signals and the other responsive to high level impulses and intermittent vibrations. Thus, different sensitivities may be used for the different channels. This allows the sensitivity for the sound channel to be higher than that of the impulse channel, which is desirable in view of the different amplitude ranges of the two types of signals to which the two channels respond.

Integration parameters for the impulse channel are oriented towards relatively long "memory" so that spaced hammer blows or intermittent high-level vibrations will build up towards the alarm threshold. In one embodiment, a massive structurally rigid vibration block anchored to the wall transmits wall-carried vibrations to the same transducing element that is utilized to sense airborne indications of intrusion. Electrets are used as transducing elements because they are low-cost, broadband, sensitive and simultaneously can function as a microphone and as an accelerometer so as to accommodate two different types of signals.

In an additional embodiment, two internal potentiometers are utilized, one for sensitivity and the other to establish integration constants for setting a minimum time period in which sequential impulses or vibrations must occur to indicate an alarm condition. This allows a measure of tailoring of the unit to different mounting surfaces and coverage radii.

A hinged cover configuration permits convenient mounting of the vibration block to a wall. A printed circuit (PC) board carrying an electret is mounted to the hinged cover, such that when the cover is swung into place, the electret is in spring-loaded engagement with the vibration block.

BRIEF DESCRIPTION OF THE DRAWING

These and other features of the subject invention will be better understood in connection with the detailed description taken in conjunction with the drawings of which.

DETAILED DESCRIPTION

Figure 1:
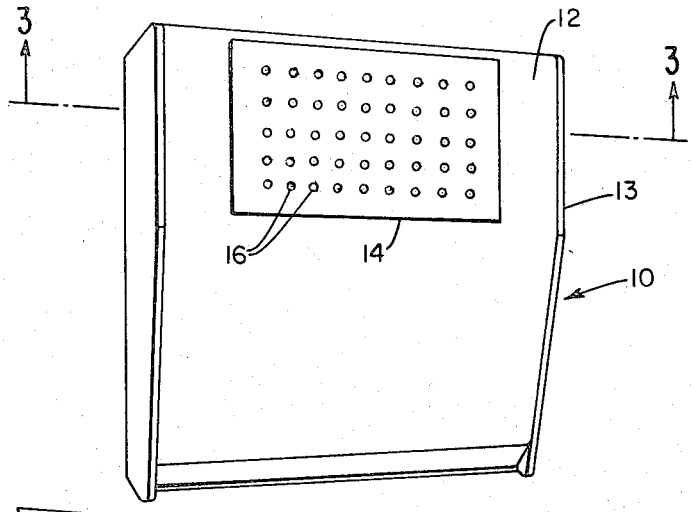
FIG. 1 is an isometric illustration of the subject sensor.

Referring now to FIG. 1, a sensor unit 10 is provided with a cover 12 hingeably secured to a housing 13 which is adapted to be securably fastened to a wall or other structural member. The unit may be provided with a face plate 14 which is perforated at 16 to admit the sounds from the surrounding area. The face plate is configured such that it permits the transmission of sound to the interior of the unit for models of the unit which are used to detect both airborne and structure-borne signals.

Figure 2:
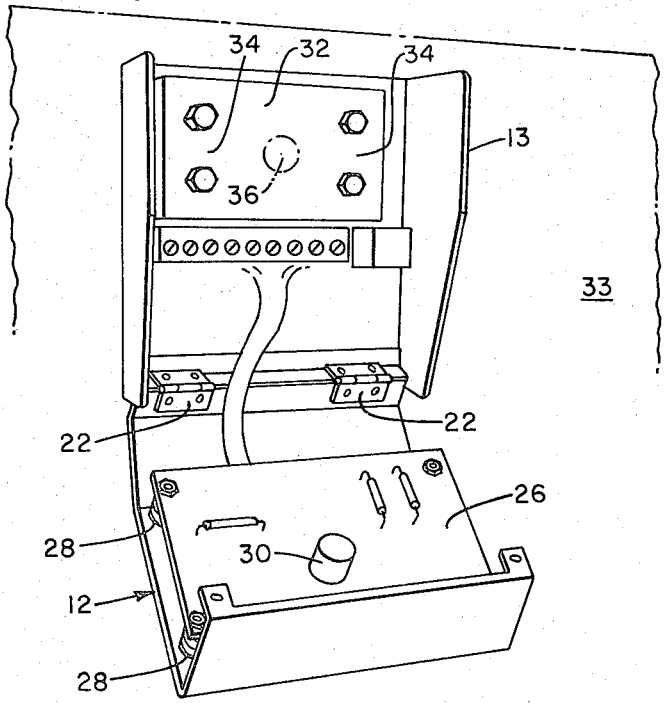
FIG. 2 is a diagrammatic representation of the unit of FIG. 1 with its hinged cover opened.

Referring to FIG. 2, cover 12 is secured via hinges 22 to housing 13. A printed circuit board 26 is resiliently mounted to housing 13 by a spring-loaded nut and bolt assembly 28 and carries on the lower side thereof a microphone/accelerometer element 30, which in one embodiment is an electret.

Figure 3:
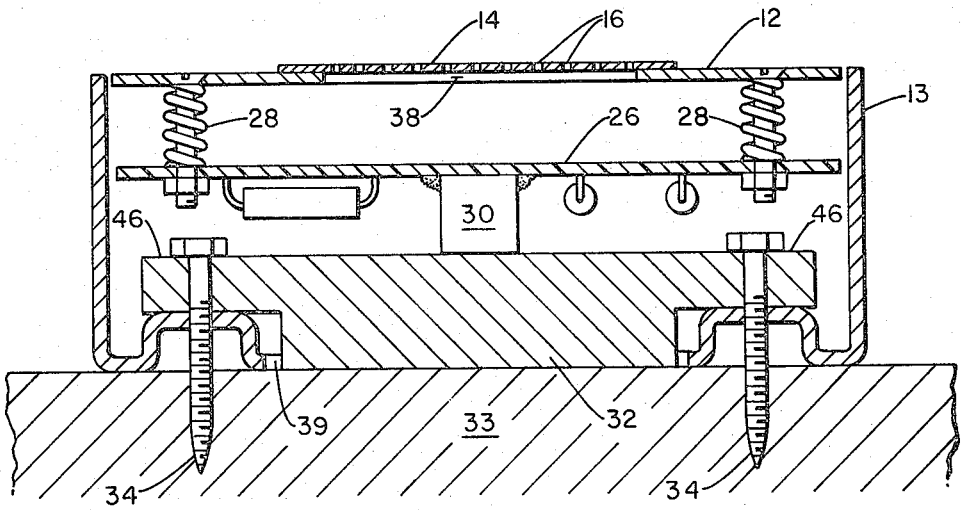
FIG. 3 is a cross-sectional illustration of a unit which senses only structurally carried signals, illustrating the arrangement of the parts in the unit and more particularly illustrating the vibration block and the spring-loaded engagement thereof by an electret mounted on a printed circuit board.

A solid vibration transmitting block 32 projects through housing 13 to a wall 33 behind the housing and is held in place by mounting bolts 34. When cover 12 is raised and secured to housing 13, electret 30 contacts vibration block 32 in the area denoted by dotted box 36 such that the electret is spring-loaded against the vibration block. The resulting spring-loaded configuration is illustrated in FIG. 3 in which like elements of FIGS. 1, 2 and 3 bear like reference characters. It will be appreciated that an aperture 38 may be provided in cover 12 so as to permit acoustic energy to enter the interior of the unit whereby acoustic energy can be detected by an electret carried on the reverse side of the circuit board as illustrated in FIGS. 4 and 5.

In FIG. 3 the unit is illustrated as being mounted to wall 33 via bolts 34 which also support vibration block 32. The vibration block firmly contacts the wall through a large rectangular aperture 39 in the rear of housing 13.

The spring mounting provided by virtue of spring-loaded nut and bolt assembly 28 urges electret 30 into contact with the vibration block such that vibrations of wall 33 are transmitted directly to electret 30. An electret suitable for use in this application is one manufactured for the Radio Shack, Inc. as Catalog No. 270092.

Figure 4:
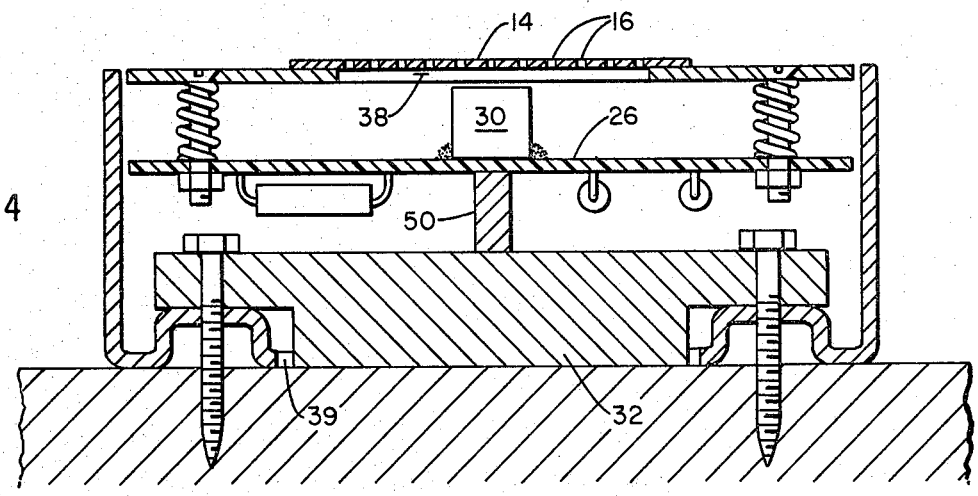
FIG. 4 is a cross-sectional illustration of a unit adapted to detect both airborne and stucture-borne signals with a single electret, illustrating the mounting of the electret on the reverse side of a printed circuit board, with a connecting linkage or shaft between the back side of the electret and the vibration block.
Figure 5:
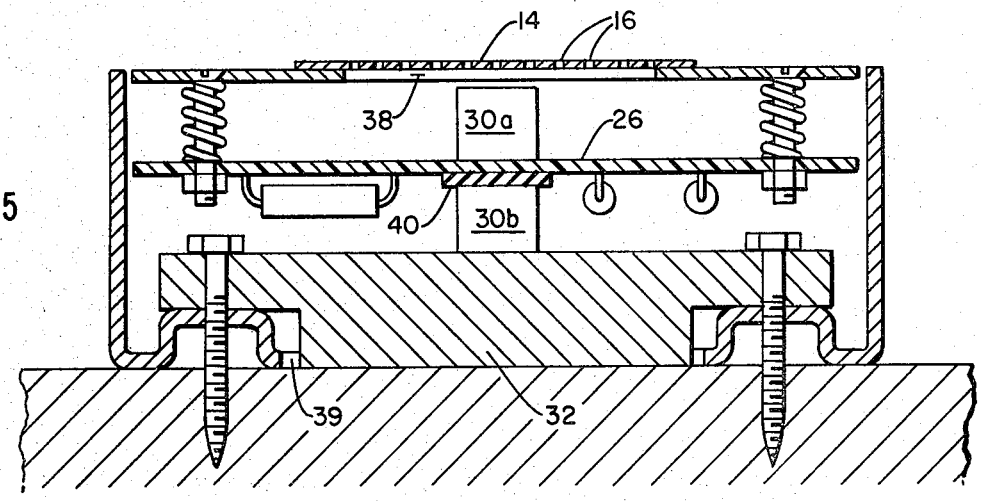
FIG. 5 is a cross-sectional illustration of a further embodiment which includes a unit adapted to detect both air-borne and structure-borne signals, illustrating the utilization of back-to-back electrets; and, FIG. 6 is a block diagram of a circuit for processing the outputs of the electret or electrets utilized respectively in the systems of FIG. 4 or 5.

Referring now to FIG. 4, an alternative embodiment useful in detecting both airborne and structure-borne signals is illustrated in which electret 30 may be mounted on the top side of printed circuit board 26. Electret 30 is positioned such that the backside of the electret is centered over a rigid shaft or other linkage means 50 provided between vibration block 32 and printed circuit board 26. This shaft transmits impulses or high level vibrational energy to the back side of the electret through the circuit board. The front side of the electret is exposed to acoustic energy coming through aperture 38. Electret 30 in this embodiment transduces the acoustic energy which is air-conducted in a manner similar to a microphone, whereas impulses or high energy vibrations are transduced in the manner of an accelerometer. In other words, the face of the electret is responsive to acoustic energy, whereas the case of the electret works against the mass of the electret diaphram to provide a signal the amplitude of which is proportional to the level of applied impulses or vibration.

In a still further alternative embodiment, and referring to FIG. 5, two electrets may be used, e.g. electret 30*a* and 30*b* which are mounted back-to-back on printed circuit board 26. Electret 30*a* responds primarily to acoustic energy coming through apertures 38, whereas electret 30*b* responds primarily to energy transmitted via vibration block 32, although electret 30*a* does have some vibration sensitivity as well. If desired, a compliant pad 40 can be used between the printed circuit board and electret 30*b* to reduce vibration transmission to electret 30*a*.

Figure 6:
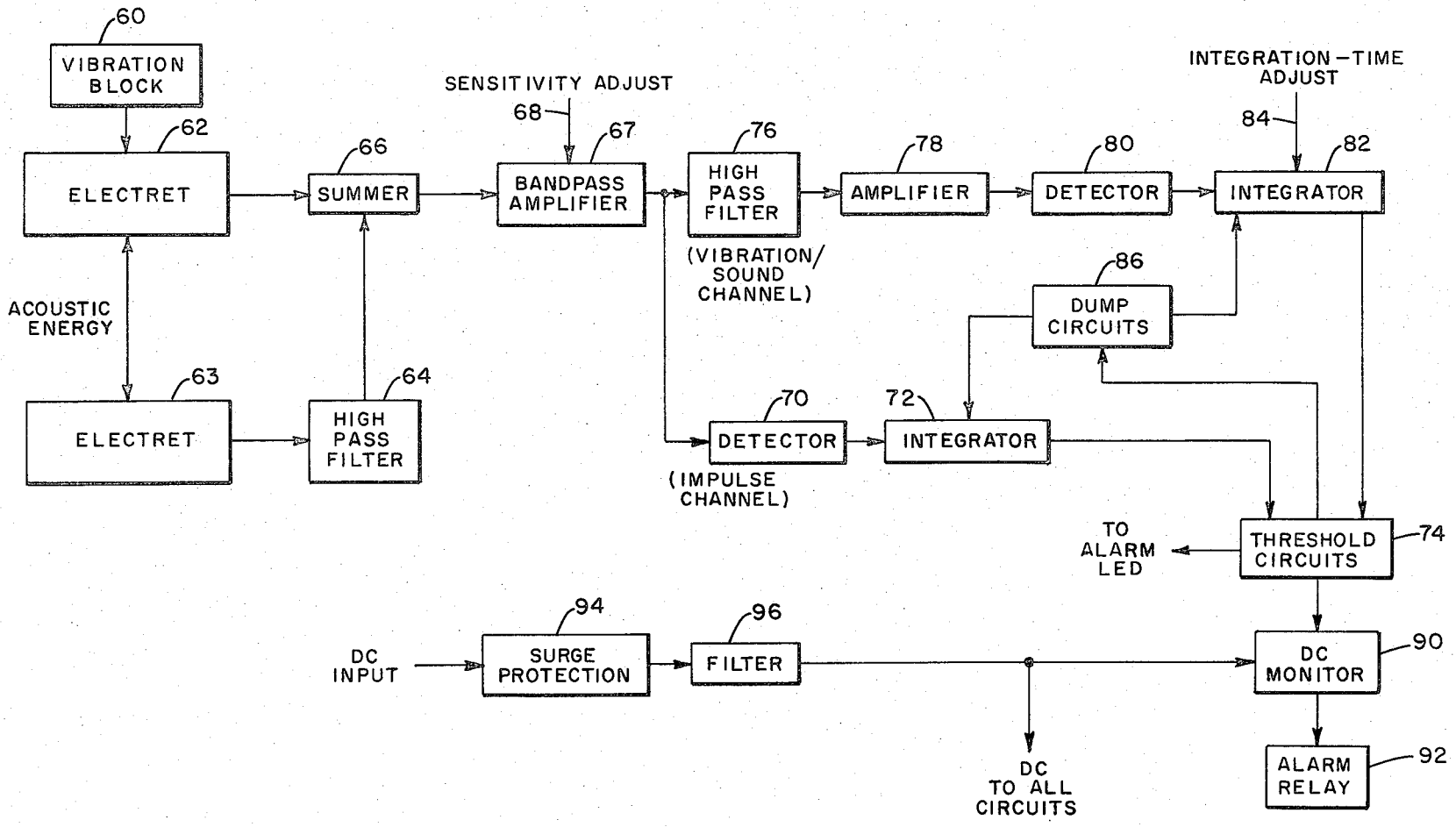

Referring now to FIG. 6, for either the single or double electret embodiments, the vibration block is diagrammatically illustrated at 60 as being mechanically coupled to electret 62 to facilitate vibration detection. Airborne acoustic signal detection is also provided by electret 62 for the FIG. 4 embodiment. Alternatively, an electret 63 may be provided to facilitate acoustic energy detection as illustrated in the FIG. 5 embodiment.

Electret 63 is coupled to a high pass filter 64 and the outputs of both high pass filter 64 and electret 62 are coupled to a summing circuit 66, the output of which is applied to a bandpass amplifier 66 provided with a sensitivity adjustment 68. The output of bandpass filter 66 is applied directly to an impulse channel detector 70, the output of which is coupled to an integrator 72 and thence to a threshold detection circuit 74. This circuit produces an alarm signal when the amplitude of an input signal thereto exceeds a predetermined threshold.

The output of bandpass amplifier 66 is also applied to a vibration/sound channel having an active high pass filter 76, the output of which is applied to an amplifier 78, coupled to a detector 80 which is in turn coupled to an integrator 82. The output of integrator 82 is applied to threshold circuit 74. An integration time adjustment, here indicated at 84, adjusts the integration time of integrator 82.

One output of threshold circuit 74 is applied to an alarm relay 92 through a DC monitor 90. The output of threshold circuit 74 is also applied to a "dump" circuit 86 the output of which is applied both to integrator 72 and to integrator 82 for resetting the integrators simultaneous with the production of an alarm signal. The DC input to the system is provided with surge protection at circuit 94, the output of which is filtered at 96 and is provided to all circuits including DC monitor 90.

In operation, high pass filter 64 is set to the aforementioned high audio band. Signals generated by activity at or adjacent a vault, safe or strong room is transmitted through summing circuit 66 and bandpass amplifier 67 to active filter 76 set to pass high audio band components. Thus detector 80 detects signals in the high audio band energy and the integration time of integrator 82 is set relatively short as compared to that of integrator 72. Integrator 82 provides an output signal when there has been a sufficient amount of activity within the protected area. The charge time of integrator 72 is considerably shorter than that of integrator 82 to be able to integrate impulses generated from hammer blows, etc. However, integrator 72 has a long decay time so that it can "remember" signals from widely-spread hammer blows. While impulse energy can exist in the vibration/sound channel, the limiting characteristic of amplifier 78 discriminates against the short duration impulses to increase the contrast between continuous vibrations or sounds and impulses or intermittent vibrations.

The subject system is provided with a "sensitivity" adjustment and also an adjustment for "minimum time to alarm" to allow some measure of tailoring of the unit to different mounting surfaces and coverage radii.

To allow the unit to be tested without having to wait for long periods of time for the integrators to decay after each test alarm, "dump" circuitry 86 is provided to erase all past memory after each alarm has occurred. To test the unit, all that is necessary is to simulate the predetermined alarm signal monitored. When a given alarm threshold has been reached as determined by threshold circuit 74, dump circuit 86 is activated to reset integrators 72 and 82.

Surge protection is provided on the DC input lines, with DC voltage levels being monitored by monitor 90 to cause the unit to go into alarm if the DC voltage falls below a point at which some loss in sensitivity might occur. In order to accomplish this, DC monitor circuit 90 monitors the DC level input and provides an alarm indication by causing alarm relay 92 to become deenergized.

Note that the two channels can be coupled to the output of a single electret such as illustrated in FIG. 4, since the two channels can distinguish impulses from other signals assuming a transducer which detects both. When a single electret is used, the channels only respond to one frequency band, whereas when two electrets are used, the frequency response of the two channels may be tailored to different requirements. Also, electrets may be replaced with other transducing elements since combinations of microphones and accelerometers are also within the scope of this invention.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. Apparatus for sensing signals structurally-conducted through a wall, comprising:

a housing having an aperture in the back thereof;

a block of material having a portion extending through said back aperture;

means for mounting said housing to said wall such that the portion of said block extending through said housing is maintained in contact with said wall;

a cover hinged to said housing;

a printed circuit board resiliently mounted to said cover; and a transducing element mounted to said printed circuit board, said board and transducing element being located such that when said cover is closed on said housing, said transducing element has a portion thereof is in mechanical spring-biased communication with said block.

2. The apparatus of claim 1 wherein said transducing element is located on the side of said printed circuit board which faces said block when said cover is closed, a portion of said transducing element contacting said block when said cover is closed so as to provide said spring-biased communication.

3. The apparatus of claim 2 and further including a second transducing element located on the side of said printed circuit board which faces away from said block, said cover having an aperture for permitting acoustic energy to travel through said cover to said second transducing element.

4. The apparatus of claim 3 wherein both of said transducing elements are electrets.

5. The apparatus of claim 1 wherein said transducing element is located on the side of said printed circuit board which faces away from said block and further including means extending between said block and said transducing element for transmitting motion of said block to said transducing element.

6. The apparatus of claim 5 wherein said cover has an aperture located so as to permit acoustic energy to pass to said transducing element, said transducing element functioning as an accelerometer and as a microphone, thereby to be responsive to both airborne and structurally-conducted signals.

7. The apparatus of claim 6 wherein said transducing element is an electret.

8. The apparatus of claim 1 wherein said transducing element is an electret.

* * * * *

UNITED STATES PATENT AND TRADEMARK OFFICE

CERTIFICATE OF CORRECTION

PATENT NO. : 4,383,250

DATED : May 10, 1983

INVENTOR(S) : Aaron A. Galvin

It is certified that error appears in the above—identified patent and that said Letters Patent is hereby corrected as shown below:

Column 1, line 21, "a" should read --an--

Column 1, line 37, "4,121,182" should read --4,121,192--

Signed and Sealed this

*Twenty-seventh* Day of *December 1983*

[SEAL]

*Attest:*

GERALD J. MOSSINGHOFF

*Attesting Officer*

*Commissioner of Patents and Trademarks*